US005768961A

United States Patent [19]

Frawley

[11] Patent Number: 5,768,961

[45] Date of Patent: Jun. 23, 1998

[54] SELF-ADJUSTING SOCKET FOR A WRENCH HANDLE

[76] Inventor: Eric L. Frawley, 2958 SW. 21st St., Gresham, Oreg. 97080

[21] Appl. No.: 767,183

[22] Filed: Dec. 16, 1996

[51] Int. Cl.[6] ..... B25B 13/18

[52] U.S. Cl. ..... 81/128; 81/59.1; 279/71; 279/81

[58] Field of Search ..... 81/128, 129, 126, 81/59.1, 90.2, 90.3, 90.9, 91.1; 279/71, 81

[56] References Cited

U.S. PATENT DOCUMENTS

| | | | |
|---|---|---|---|
| 2,701,724 | 2/1955 | Harris | 279/71 |
| 5,315,902 | 5/1994 | Ragland et al. | 279/71 X |
| 5,390,573 | 2/1995 | Mann | 81/59.1 X |
| 5,577,743 | 11/1996 | Kanaan et al. | 279/81 X |

*Primary Examiner*—D. S. Meislin
*Attorney, Agent, or Firm*—Michael I. Kroll

[57] ABSTRACT

A self-adjusting socket (14) for a wrench handle (16) having a drive end (18) with a ratchet reverse lever (20) and a square peg (21). The socket (14) comprises a cylindrical wall (22). A component (24) is rotatively carried in a top end (26) of the cylindrical wall (22, for coupling the square peg (21) of the wrench handle (16) thereto. A plurality of movable pins (28) are provided. A structure (30) is rotatively carried below the coupling component (24) in the cylindrical wall (22), for engaging with the movable pins (28). Elements (32) are for connecting the coupling component (24) to the movable pin engaging structure (30). A facility (34) is fixed within a bottom end (36) of the cylindrical wall (22) below the movable pin engaging structure (30), for guiding the movable pins (28) radially inwardly towards the center, to contact a hex nut/hex bolt head (38) when the hex nut/hex bolt head (38) is inserted into the movable pin guiding facility (34) and the wrench handle (16) is turned to apply torque thereto.

23 Claims, 8 Drawing Sheets

32
84
46
58
24
44
74
74
52
30
60
34
74
66
28
38
48
68

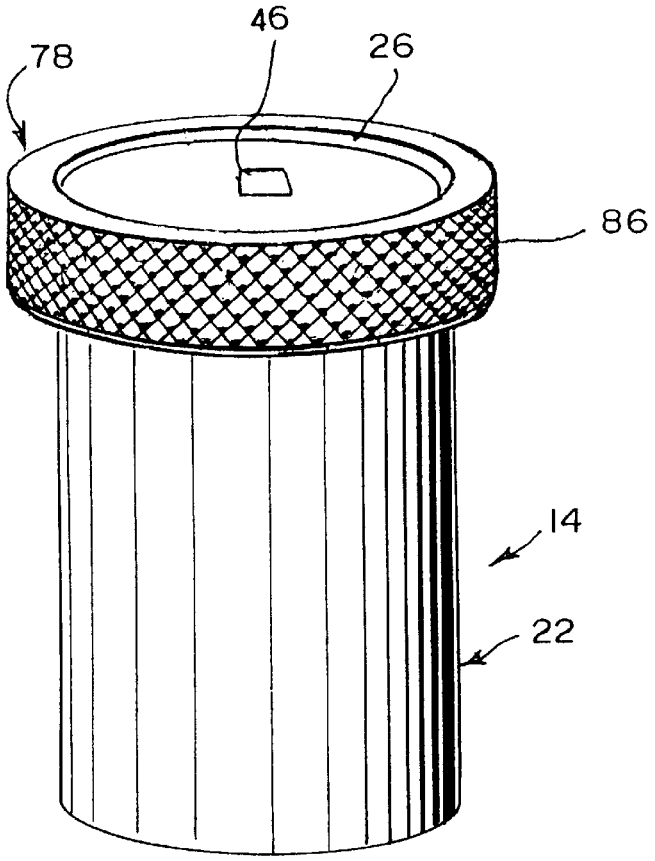
Fig. 15
Fig. 16
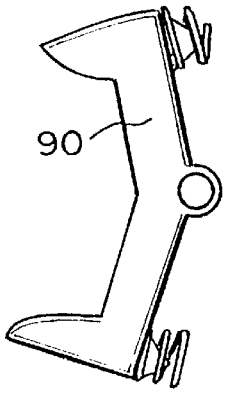

SELF-ADJUSTING SOCKET FOR A WRENCH HANDLE

BACKGROUND OF THE INVENTION

1. Field of the Invention

The instant invention relates generally to wrenches and more specifically is a self-adjusting socket for a wrench handle.

2. Description of the Prior Art

Numerous wrenches have been provided in prior art that are any of various hand or power tools with fixed or adjustable jaws for gripping, turning or twisting an object, such as a nut, bolt or pipe. While these units may be suitable for the particular purpose to which they address, they would not be as suitable for the purposes of the present invention as heretofore described.

SUMMARY OF THE INVENTION

A primary object of the present invention is to provide a self-adjusting socket for a wrench handle that will overcome the shortcomings of the prior art devices.

Another object is to provide a self-adjusting socket for a wrench handle that is made to automatically fit a variety of nut or bolt head sizes, by having the ability to adjust from one nut or bolt head to another with minimal effort.

An additional object is to provide a self-adjusting socket for a wrench handle that will simplify assembly and disassembly of mechanical devices and to limit trips to the tool box or work bench for finding the exact size socket for the matching nut or bolt head.

A further object is to provide a self-adjusting socket for a wrench handle that is simple and easy to use.

A still further object is to provide a self-adjusting socket for a wrench handle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 15 is a diagrammatic top perspective view taken in the direction of arrow 15 in FIG. 2, with the wrench handle removed therefrom, showing the locations of the slots and access holes in the cylindrical wall for the automatic lock assembly.

FIG. 16 is a top view of the rocker arm shown in FIG. 14.

Similar reference characters denote corresponding features consistently throughout the attached drawings.

DETAILED DESCRIPTION OF THE PREFERRED EMBODIMENTS

Figure 1:
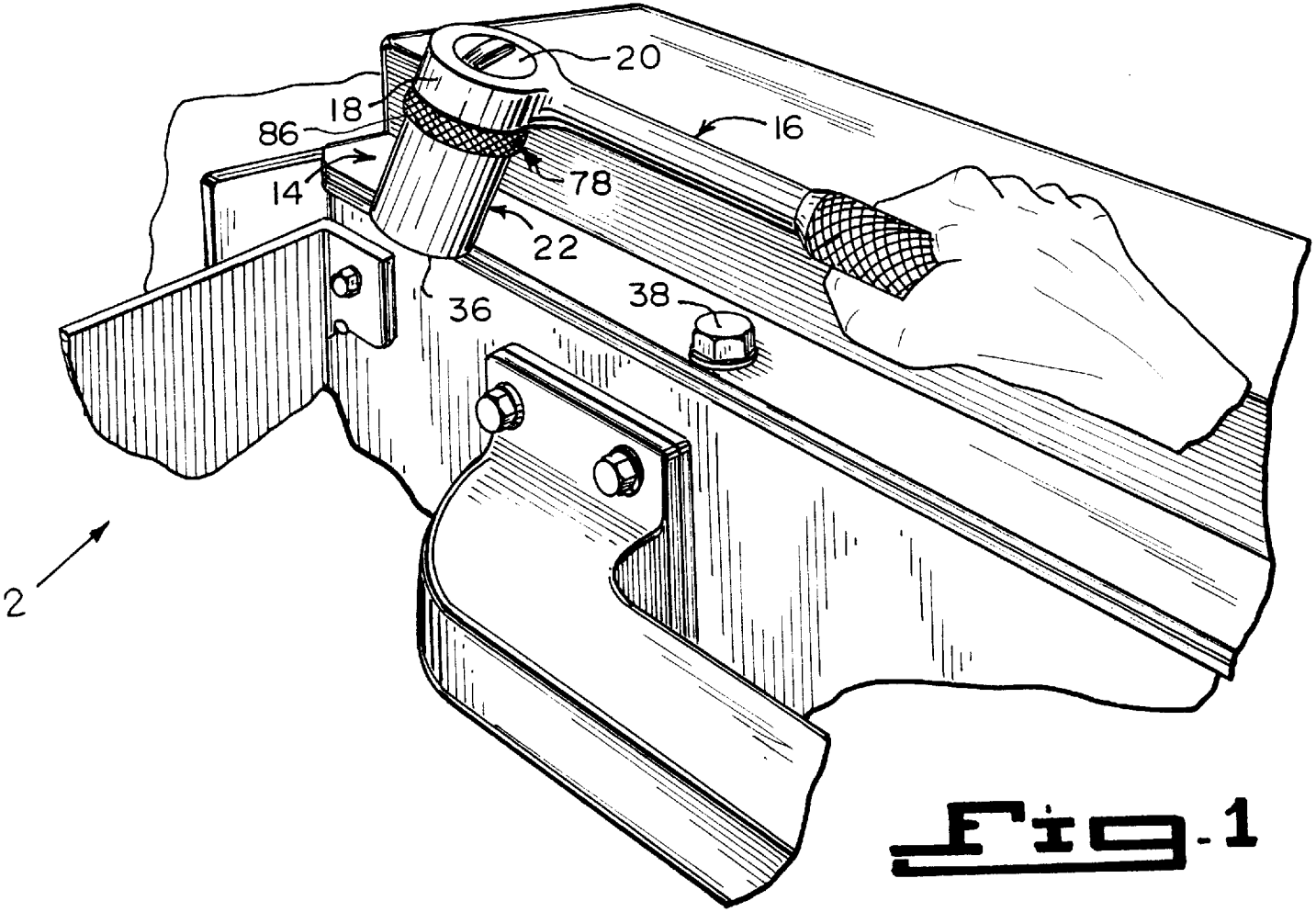
FIG. 1 is a top perspective view showing the instant invention ready to be used with a wrench handle in engaging with a bolt head on a piece of machinery.
Figures 2, 3:
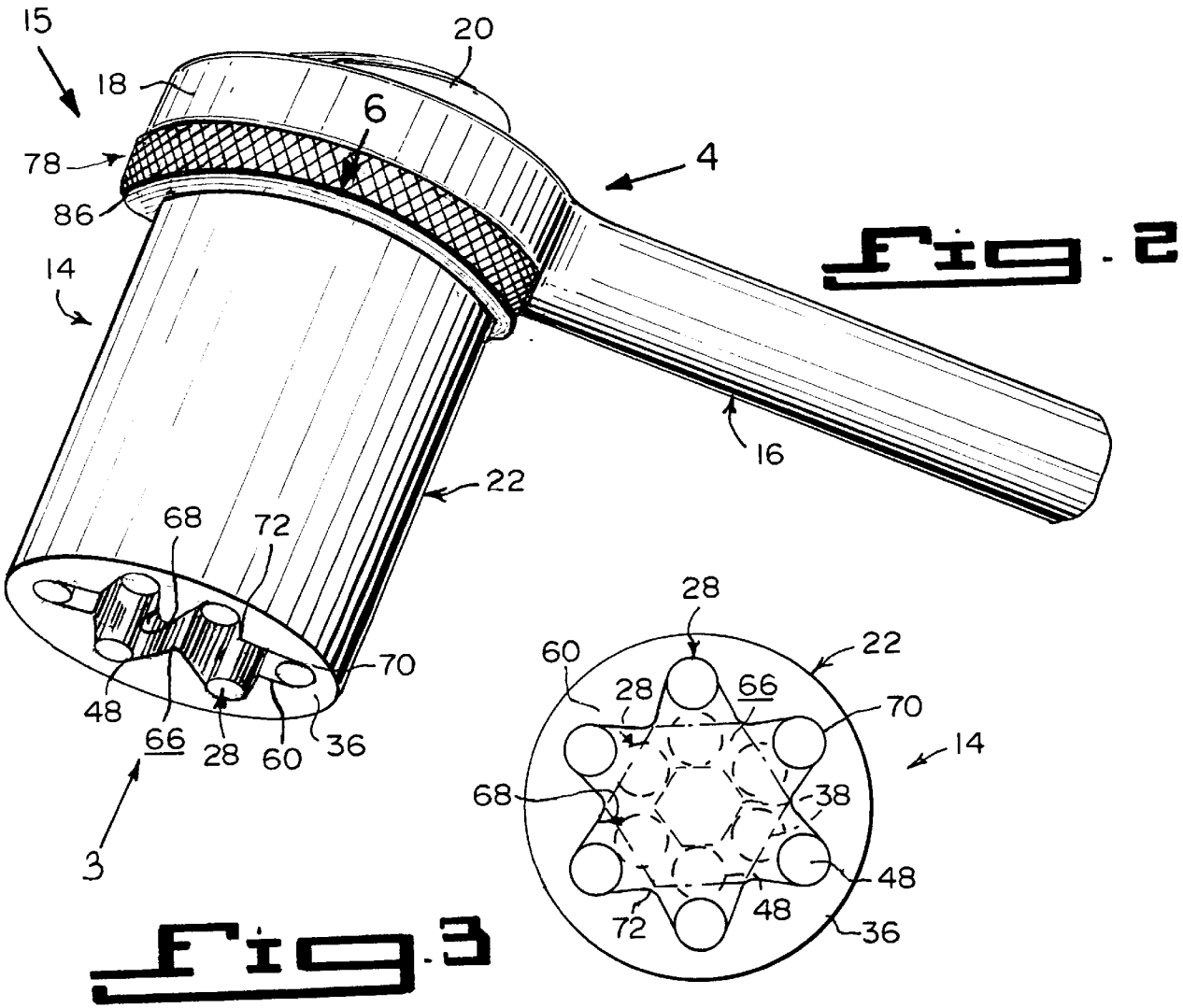
FIG. 2 is an enlarged bottom perspective view taken in the direction of arrow 2 in FIG. 1, with the wrench handle broken away.
FIG. 3 is a bottom view taken in the direction of arrow 3 in FIG. 2, with the automatic lock assembly and the wrench handle removed therefrom.
Figure 4:
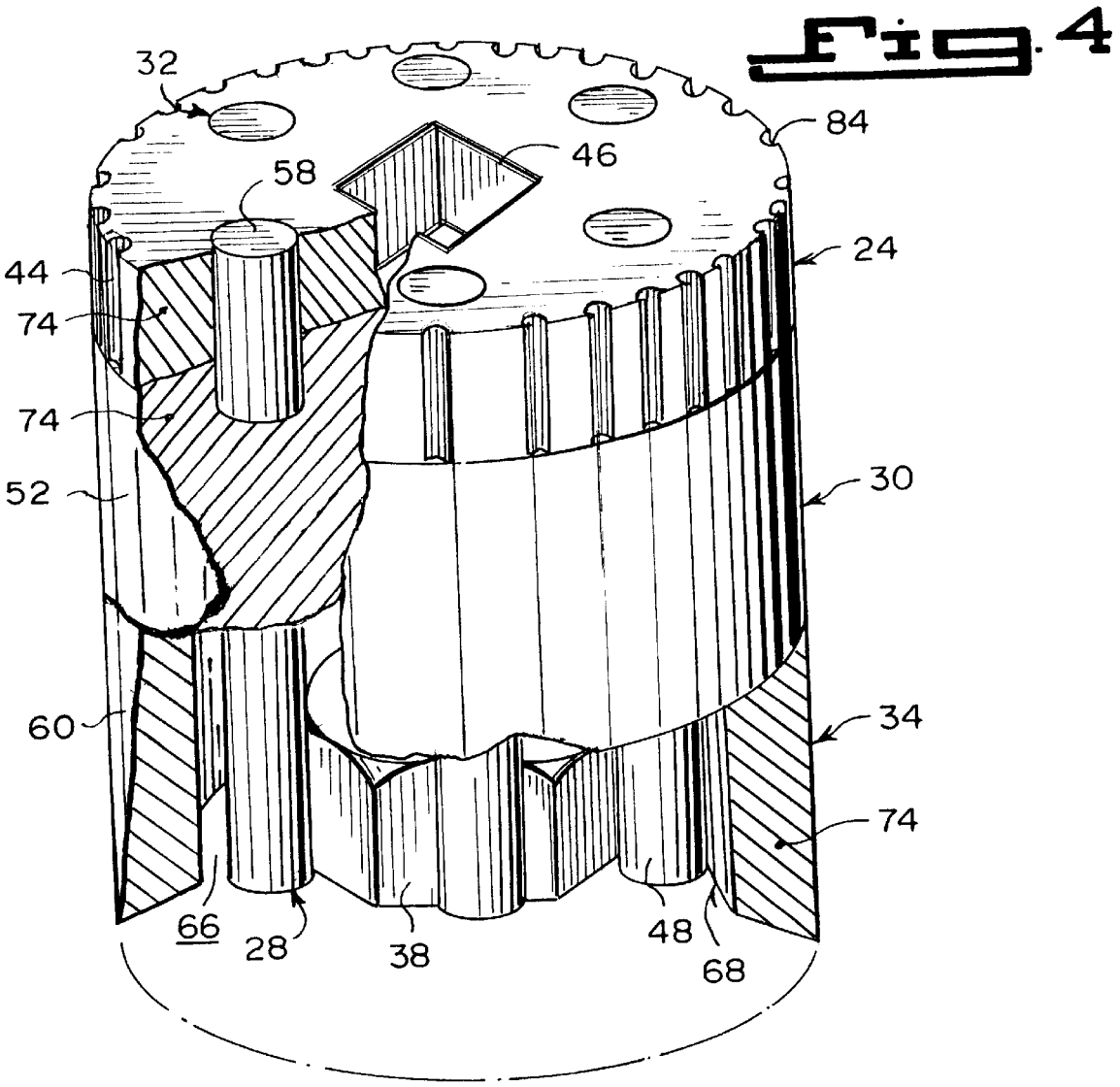
FIG. 4 is an enlarged top perspective view of the instant invention per se, taken in the direction of arrow 4 in FIG. 2, with the automatic lock assembly and the cylindrical wall removed and other parts broken away and in section.
Figure 5:
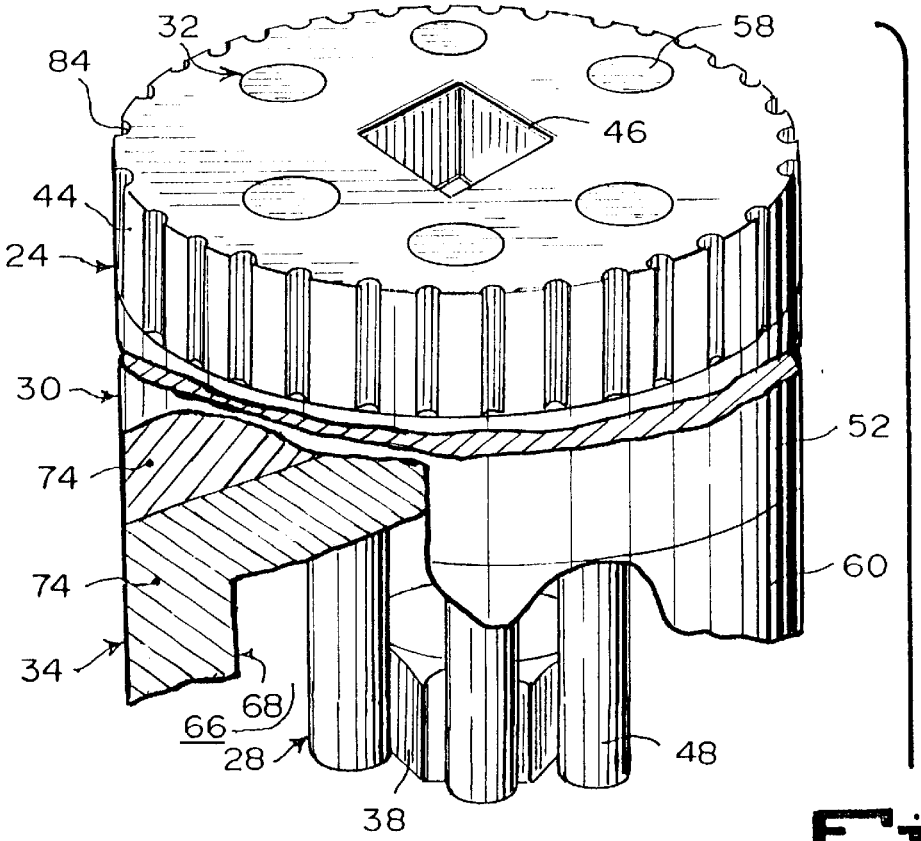
FIG. 5 is an enlarged top perspective view similar to FIG. 4, with various parts broken away and in section.
Figure 6:
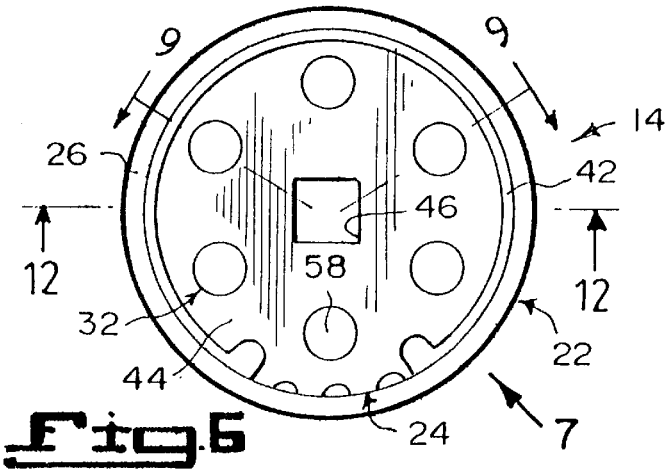
FIG. 6 is a top view taken in the direction of arrow 6 in FIG. 2, with the automatic lock assembly and the wrench handle removed therefrom.
Figure 7:
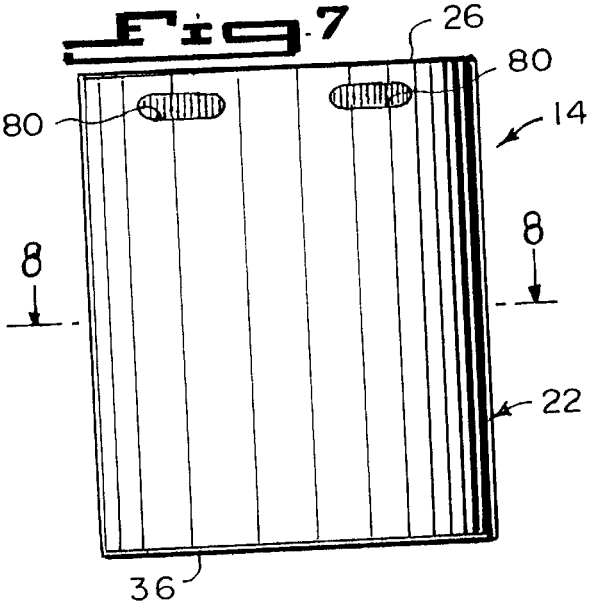
FIG. 7 is an enlarged elevational view taken in the direction of arrow 7 in FIG. 6.
Figure 8:
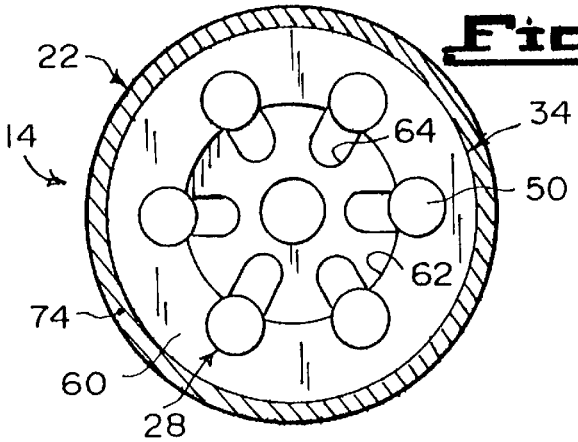
FIG. 8 is a cross sectional view taken along line 8—8 in FIG. 7.
Figure 9:
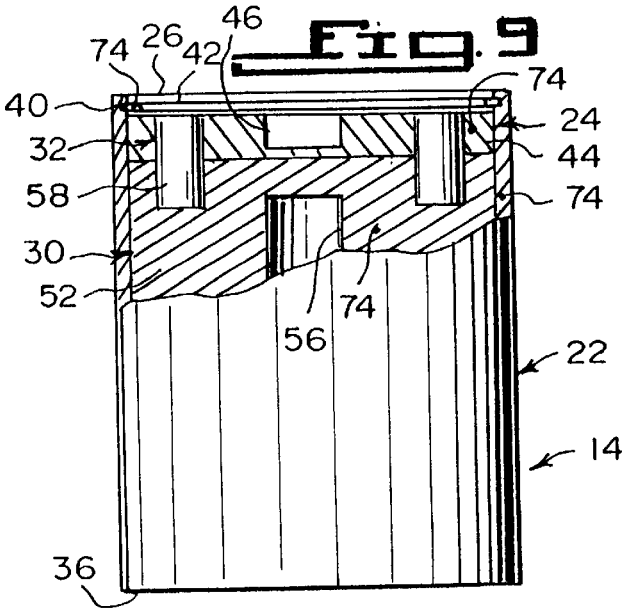
FIG. 9 is a partial cross sectional view taken along line 9—9 in FIG. 6.
Figure 10:
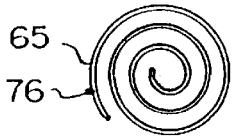
FIG. 10 is a top view of the spiral spring.
Figure 11:
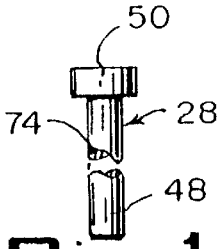
FIG. 11 is an elevational view, with parts broken away of one of the movable pins.
Figure 12:
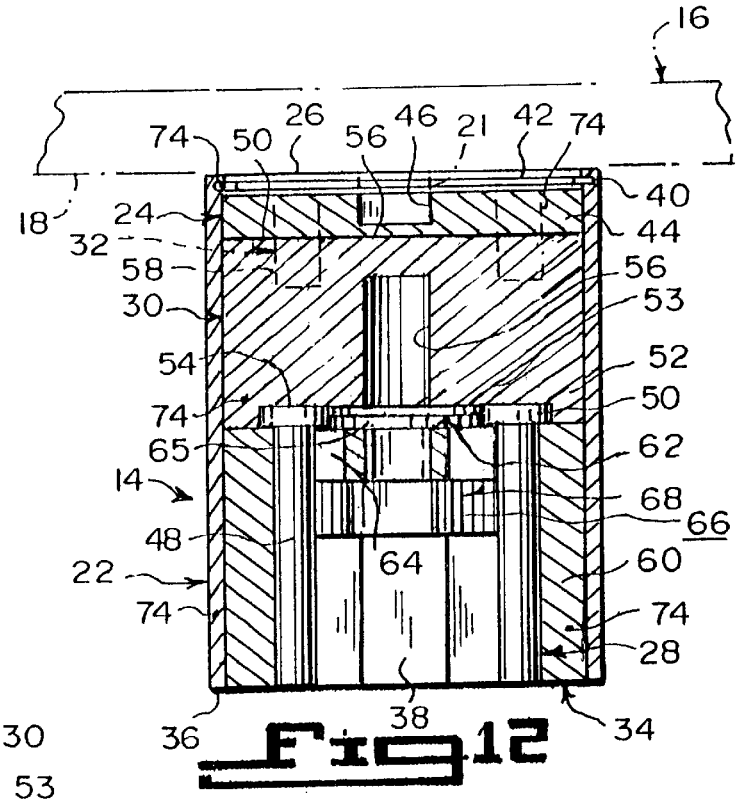
FIG. 12 is a cross sectional view taken along line 12—12 in FIG. 6.
Figure 13:
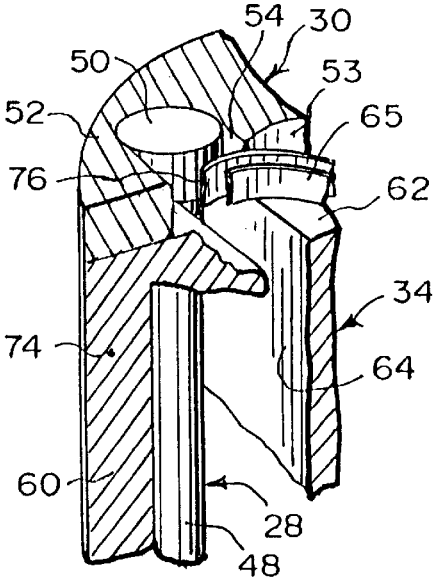
FIG. 13 is a partial perspective view showing a portion of the cylindrical route member, movable pin and spiral spring.

Turning now descriptively to the drawings, in which similar reference characters denote similar elements throughout the several views, FIGS. 1 through 15 illustrate a self-adjusting socket 14 for a wrench handle 16 having a drive end 18 with a ratchet reverse lever 20 and a square peg 21. The socket 14 comprises a cylindrical wall 22. A component 24 is rotatively carried in a top end 26 of the cylindrical wall 22, for coupling the square peg 21 of the wrench handle 16 thereto. A plurality of movable pins 28 are provided.

A structure 30 is rotatively carried below the coupling component 24 in the cylindrical wall 22, for engaging with the movable pins 28. Elements 32 are for connecting the coupling component 24 to the movable pin engaging structure 30. A facility 34 is fixed within a bottom end 36 of the cylindrical wall 22 below the movable pin engaging structure 30, for guiding the movable pins 28 radially inwardly towards the center, to contact a hex nut/hex bolt head 38 when the hex nut/hex bolt head 38 is inserted into the movable pin guiding facility 34 and the wrench handle 16 is turned to apply torque thereto.

The cylindrical wall 22 has an inner annular groove 40 directly below the top end 26. A snap ring 42 fits into the inner annular groove 40, to hold the coupling component 24 therein in a rotative manner. The coupling component 24 is a cylindrical attachment plate 44, having a central square hole 46 to receive the square peg 21 of the wrench handle 16.

Each movable pin 28 includes an elongated round shank 48. An enlarged round head 50 is on a top end of the elongated round shank 48, for stability of the movable pin 28. The movable pin engaging structure 30 is a cylindrical housing 52, having a bottom central recess 53 with a plurality of radial slots 54 for retaining each enlarged round head 50 of each movable pin 28 therein in a sliding manner. A bottom central bore 56 is to receive a threaded shaft from the hex nut 38. The connecting elements 32 are a plurality of stationary pins 58 radially positioned and vertically driven through the coupling component 24 and the movable pin engaging structure 30.

The movable pin guiding facility 34 includes a cylindrical route member 60. The cylindrical route member 60 has a top central recess 62 with a plurality of radial slots 64 for retaining each elongated round shank 48 of each movable pin 28 therein in a sliding manner. A spiral spring 65 fits into the top central recess 62 to contact the enlarged round heads 50 of the movable pins 28, to normally keep the movable pins 28 outwardly in the radial slots 64.

The cylindrical route member 60, h as a bottom central aperture 66 with an inner cam surface 68, having a plurality of low positions 70 and a plurality of high positions 72. When the hex nut/hex bolt head 38 is inserted into the bottom central aperture 66 and the coupling component 24 with the movable pin engaging structure 30 are both rotated within the cylindrical wall 22 by the square peg 21 on the drive end 18 of the wrench handle 16, the movable pins 28 will ride on the inner cam surface 68 until enagement is made with the hex nut/hex bolt head 38 to tighten and loosen depending upon direction the wrench handle 16 is turned.

The cylindrical wall 22, the coupling component 24, movable pins 28, the movable pin engaging structure 30, connecting elements 32 and the movable pin guiding facility 34 are all fabricated out of a strong durable metal material 74. The snap ring 42 is also fabricated out of the strong durable metal material 74. The spiral spring 65 is fabricated out of a flexible metal material 76.

Torque is applied by the wrench handle 16 via the drive end 18 with the square peg 21 in the central square hole 46 in the cylindrical attachment plate 44. The cylindrical attachment plate 44 transfers torque to the cylindrical housing 52 by the stationary pins 58, which then transfers torque to the movable pins 28. The movable pins 28 then ride inwardly on the radial slots 54 and 64, and are pushed in by riding along the inner cam surface 68 on the cylindrical route member 60, until contact is made with the hex nut/hex bolt head 38 by the elongated round shanks 48 wedging between the cylindrical wall 22 and the hex nut/hex bolt head 38. All torque is applied to the hex nut/hex bolt head 38, to loosen or tighten depending on the direction of rotation by the wrench handle 16, wherein the movable pin 28 can adjust to any size hex nut/hex bolt head 38 whether metric or American types. The spiral spring 65 will return the movable pins 28 back to their original position.

An automatic nut lock assembly 78 is adjustably connected about the cylindrical wall 22 near the top end 26 thereof. The automatic nut lock assembly 78 will hold nut sizes from one job to another with minimal effort, and to keep the spiral spring 65 from returning the movable pins 28 back to their normal position during a procedure. The automatic nut lock assembly 78 has a tighten, neutral and loosen position as it is moved radially around the cylindrical wall 22.

The automatic nut lock assembly 78 includes the cylindrical wall 22 having two slots 80 and two adjacent access holes 82 radially spaced apart near the top end 26. The cylindrical attachment plate 44 further has a plurality of vertical notches 84 radially spaced about its circumference. A knurled donut shaped housing 86 is sized to adjustably fit about the cylindrical wall 22 near the top end 26. A pair of spring loaded T-pins 88 are carried in the knurled donut shaped housing 86. Each T-pin 88 can fit into one slot 80 in the cylindrical wall 22, to stabilize the knurled donut shaped housing 86.

Figure 14:
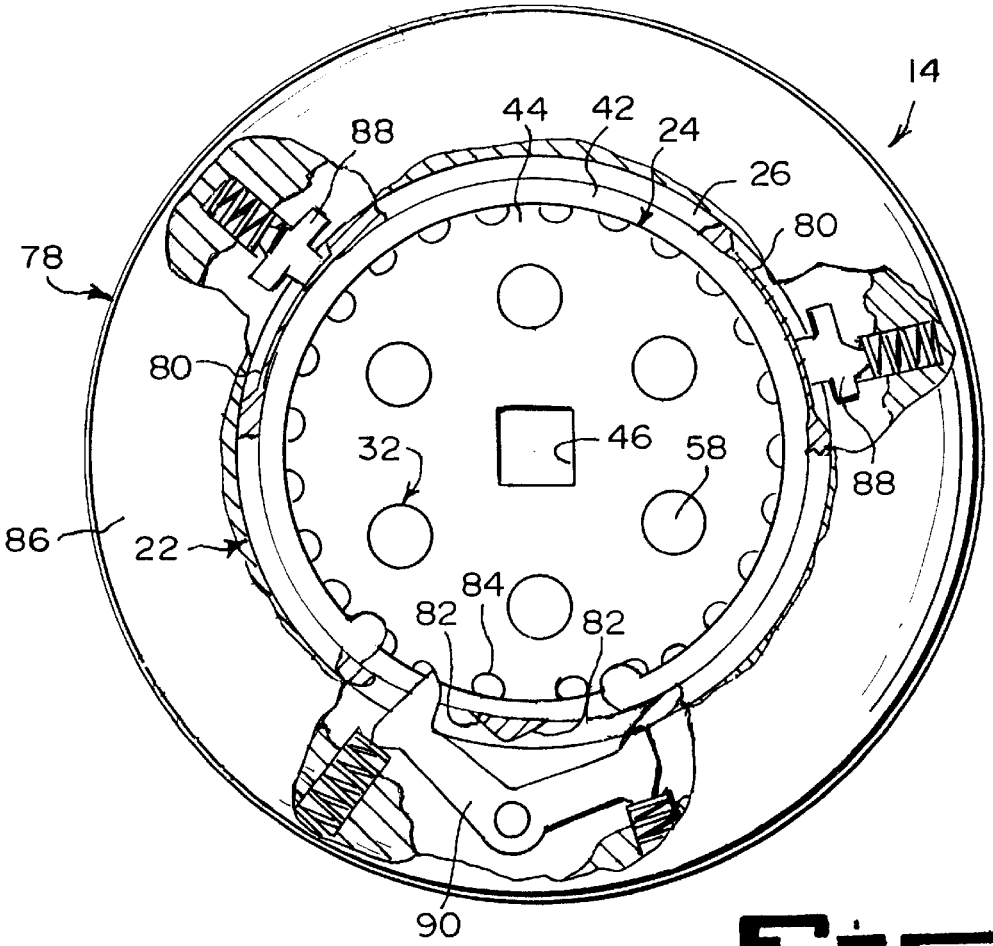
FIG. 14 is a top view similar to FIG. 6, with the automatic lock assembly in place and parts broken away and in section.

A dual spring loaded rocker arm lock mechanism 90, as shown in FIGS. 14 and 16, is carried in the knurled donut shaped housing 86. The rocker arm lock mechanism 90 can engage with one of the vertical notches 84 in the cylindrical attachment plate 44 through one of the access holes 82 in the cylindrical wall 22. The knurled donut shaped housing 86 of the automatic nut lock assembly 78 can go into three positions as it is adjusted about the cylindrical wall 22. The first being adjusted into a counterclockwise position for a nut size finding while tightening the hex nut/hex bolt head 38. The second being adjusted into a clockwise position to retain the nut size while loosening the hex nut/hex bolt head 38. The third being adjusted into a neutral position found in between the first counterclockwise position and the second clockwise position, to allow the spiral spring 65 to return the movable pins 28 to a maximum nut size position.

The pair of spring loaded T-pins 88 that are maintained in the slots 80 and the spring loaded rocker arm lock mechanism 90 that is maintained through one of the access holes 82 are not disengaged once they have been engaged. They merely serve to keep the knurled donut shaped housing 86 from falling off of the cylindrical wall 22.

LIST OF REFERENCE NUMBERS

14 self-adjusting socket
16 wrench handle
18 drive end of 16
20 ratchet reverse lever of 16
21 square peg of 16
22 cylindrical wall of 14
24 couping component of 14
26 top end of 22
28 movable pin of 14
30 movable pin engaging structure of 14
32 connecting element of 14
34 movable pin guiding facility of 14
36 bottom end of 22
38 hex nut/hex bolt head
40 inner annular groove in 22
42 snap ring 40
44 cylindrical attachment plate for 24
46 central square hole in 44
48 elongated round shank of 28
50 enlarged round head of 28 on 48
52 cylindrical housing for 30
53 bottom central recess in 52
54 radial slot in 52 for 50
56 bottom central bore in 52
58 stationary pin of 32
60 cylindrical route member for 34
62 top central recess in 60
64 radial slot in 60 for 48
65 spiral spring in 62
66 bottom central aperture in 60
68 inner cam surface on 66

70 low position of 68

72 high position of 68

74 strong durable metal material for 22, 24, 28, 30, 32, 34 and 42

76 flexible metal material for 65

78 automatic nut lock assembly

80 slot in 22

82 access hole in 22

84 vertical notch on 44

86 knurled donut shaped housing of 78

88 spring loaded T-pin of 78

90 dual spring loaded rocker arm lock mechanism of 78

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A self-adjusting socket for a wrench handle having a drive end with a ratchet reverse lever and a square peg, said socket comprising:

a) a cylindrical wall;

b) means rotatively carried in a top end of said cylindrical wall, for coupling the square peg of the wrench handle thereto;

c) a plurality of movable pins;

d) means rotatively carried below said coupling means in said cylindrical wall, for engaging with said movable pins;

e) means for connecting said coupling means to said movable pin engaging means; and f) means fixed within a bottom end of said cylindrical wall below said movable pin engaging means, for guiding said movable pins radially inwardly towards the center, to contact a hex nut/hex bolt head when the hex nut/hex bolt head is inserted into said movable pin guiding means and the wrench handle is turned to apply torque thereto.

2. A self-adjusting socket as recited in claim 1, further including:

a) said cylindrical wall having an inner annular groove directly below said top end; and b) a snap ring to fit into said inner annular groove to hold said coupling means therein in a rotative manner.

3. A self-adjusting socket as recited in claim 1, wherein said coupling means is a cylindrical attachment plate having a central square hole to receive the square peg of the wrench handle.

4. A self-adjusting socket as recited in claim 1, wherein each said movable pin includes:

a) an elongated round shank; and b) an enlarged round head on a top end of said elongated round shank for stability of said movable pin.

5. A self-adjusting socket as recited in claim 4, wherein said movable pin engaging means is a cylindrical housing having a bottom central recess with a plurality of radial slots for retaining each said enlarged round head of each said movable pin therein in a sliding manner and a bottom central bore to receive a threaded shaft from the hex nut.

6. A self-adjusting socket as recited in claim 1, wherein said connecting means includes a plurality of stationary pins radially positioned and vertically driven through said coupling means and said movable pin engaging means.

7. A self-adjusting socket as recited in claim 4, wherein said movable pin guiding means includes:

a) a cylindrical route member;

b) said cylindrical route member having a top central recess, with a plurality of radial slots for retaining each said elongated round shank of each said movable pin therein in a sliding manner;

c) a spiral spring to fit into said top central recess to contact said enlarged round heads of said movable pins to normally keep said movable pins outwardly in said radial slots; and d) said cylindrical route member having a bottom central aperture with an inner cam surface having a plurality of low positions and a plurality of high positions, so that when the hex nut/hex bolt head is inserted into said bottom central aperture and said coupling means with said movable pin engaging means are both rotated within said cylindrical wall by the square peg on the drive end of the wrench handle, said movable pins will ride on said inner cam surface until engagement is made with the hex nut/hex bolt head to tighten and loosen depending upon direction the wrench handle is turned.

8. A self-adjusting socket as recited in claim 1, wherein said cylindrical wall, said coupling means, said movable pins, said movable pin engaging means, said connecting means and said movable pin guiding means are all fabricated out of a strong durable metal material.

9. A self-adjusting socket as recited in claim 2, wherein said snap ring is fabricated out of a strong durable metal material.

10. A self-adjusting socket as recited in claim 6, wherein said spiral spring is fabricated out of a flexible metal material.

11. A self-adjusting socket as recited in claim 7, further including an automatic nut lock assembly adjustably connected about said cylindrical wall near the top end thereof, so as to hold nut sizes from one job to another with minimal effort, and to keep said spiral spring from returning said movable pins back to their normal position during a procedure.

12. A self-adjusting socket as recited in claim 11, wherein said automatic nut lock assembly includes:

a) said cylindrical wall having two slots and two adjacent access holes radially spaced apart near the top end;

b) said cylindrical attachment plate further having a plurality of vertical notches radially spaced about its circumference;

c) a knurled donut shaped housing sized to adjustably fit about said cylindrical wall near the top end;

d) a pair of spring loaded T-pins carried in said knurled donut shaped housing, whereby each said T-pin can fit into one said slot in said cylindrical wall to stabilize said donut shaped housing; and e) a dual spring loaded rocker arm lock mechanism carried in said knurled donut shaped housing, whereby said rocker arm lock mechanism can engage with one of said vertical notches in said cylindrical attachment plate through one of said access holes in said cylindrical wall, in which said knurled donut shaped housing of said automatic nut lock assembly can go into three positions as it is adjusted about said cylindrical wall, first being adjusted into a counterclockwise position for a nut size finding while tightening the hex nut/hex bolt head, second adjusted into a clockwise position to retain the nut size while loosening the hex nut/hex bolt head, and third adjusted into a neutral position found in between the first counterclockwise position and the second clockwise position, to allow said spiral spring to return said movable pins to a maximum nut size position.

13. A self-adjusting socket for a wrench handle having a drive end with a ratchet reverse lever and a square peg, said socket comprising:

a) a cylindrical wall;

b) means rotatively carried in a top end of said cylindrical wall, for coupling the square peg of the wrench handle thereto;

c) a plurality of movable pins;

d) means rotatively carried below said coupling means in said cylindrical wall, for engaging with said movable pins;

e) means for connecting said coupling means to said movable pin engaging means;

f) means fixed within a bottom end of said cylindrical wall below said movable pin engaging means, for guiding said movable pins radially inwardly towards the center, to contact a hex nut/hex bolt head when the hex nut/hex bolt head is inserted into said movable pin guiding means and the wrench handle is turned to apply torque thereto;

g) said cylindrical wall having an inner annular groove directly below said top end; and h) a snap ring to fit into said inner annular groove to hold said coupling means therein in a rotative manner.

14. A self-adjusting socket as recited in claim 13, wherein said coupling means is a cylindrical attachment plate having a central square hole to receive the square peg of the wrench handle.

15. A self-adjusting socket as recited in claim 14, wherein each said movable pin includes:

a) an elongated round shank; and b) an enlarged round head on a top end of said elongated round shank for stability for said movable pin.

16. A self-adjusting socket as recited in claim 15, wherein said movable pin engaging means is a cylindrical housing having a bottom central recess with a plurality of radial slots for retaining each said enlarged round head of each said movable pin therein in a sliding manner and a bottom central bore to receive a threaded shaft from the hex nut.

17. A self-adjusting socket as recited in claim 16, wherein said connecting means includes a plurality of stationary pins radially positioned and vertically driven through said coupling means and said movable pin engaging means.

18. A self-adjusting socket as recited in claim 17, wherein said movable pin guiding means includes:

a) a cylindrical route member;

b) said cylindrical route member having a top central recess with a plurality of radial slots for retaining each said elongated round shank of each said movable pin therein in a sliding manner;

c) a spiral spring to fit into said top central recess to contact said enlarged round heads of said movable pins to normally keep said movable pins outwardly in said radial slots; and d) said cylindrical route member having a bottom central aperture with an inner cam surface having a plurality of low positions and a plurality of high positions, so that when the hex nut/hex bolt head is inserted into said bottom central aperture and said coupling means with said movable pin engaging means are both rotated within said cylindrical wall by the square peg on the drive end of the wrench handle, said movable pins will ride on said inner cam surface until engagement is made with the hex nut/hex bolt head to tighten and loosen depending upon the direction the wrench handle is turned.

19. A self-adjusting socket as recited in claim 18, wherein said cylindrical wall, said coupling means, said movable pins, said movable pin engaging means, said connecting means and said movable pin guiding means are all fabricated out of a strong durable metal material.

20. A self-adjusting socket as recited in claim 19, wherein said snap ring is fabricated out of a strong durable metal material.

21. A self-adjusting socket as recited in claim 20, wherein said spiral spring is fabricated out of a flexible metal material.

22. A self-adjusting socket as recited in claim 21, further including an automatic nut lock assembly adjustably connected about said cylindrical wall near the top end thereof, so as to hold nut sizes from one job to another with minimal effort, and to keep said spiral spring from returning said movable pins back to their normal position during a procedure.

23. A self-adjusting socket as recited in claim 22, wherein said automatic nut lock assembly includes:

a) said cylindrical wall having two slots and two adjacent access holes radially spaced apart near the top end;

b) said cylindrical attachment plate further having a plurality of vertical notches radially spaced about its circumference;

c) a knurled donut shaped housing sized to adjustably fit about said cylindrical wall near the top end;

d) a pair of spring loaded T-pins carried in said knurled donut shaped housing, whereby each said T-pin can fit into one said slot in said cylindrical wall to stabilize said knurled donut shaped housing; and e) a dual spring loaded rocker arm lock mechanism carried in said knurled donut shaped housing, whereby said rocker arm lock mechanism can engage with one of said vertical notches in said cylindrical attachment plate through one of said access holes in said cylindrical wall, in which said knurled donut shaped housing of said automatic nut lock assembly can go into three positions as it is adjusted about said cylindrical wall, first being adjusted into a counterclockwise position for a nut size finding while tightening the hex nut/hex bolt head, second being adjusted into a clockwise position to retain the nut size while loosening the hex nut/hex bolt head, and third adjusted into a neutral position found in between the first counterclockwise position and the second clockwise position, to allow said spiral spring to return said movable pins to a maximum nut size position.

* * * * *